United States Patent [19]

Mente et al.

[11] 4,126,849

[45] Nov. 21, 1978

[54] ELEVATOR CALL CIRCUIT

[75] Inventors: Alfred C. Mente, Westwood; Paul E. LePore, Taunton, both of Mass.

[73] Assignee: Delta Elevator Equipment Corporation, Allston, Mass.

[21] Appl. No.: 792,065

[22] Filed: Apr. 29, 1977

[51] Int. Cl.[2] ..... G08B 5/36

[52] U.S. Cl. ..... 340/19 R; 340/332; 340/503

[58] Field of Search ..... 340/19 R, 20, 21, 213.2, 340/226, 332; 187/29 S, 29 AP

[56] References Cited

U.S. PATENT DOCUMENTS

| | | | |
|---|---|---|---|
| 2,852,756 | 9/1958 | Eames | 340/19 R |
| 2,936,858 | 5/1960 | Hornung et al. | 340/19 R |
| 3,124,793 | 3/1964 | Foster | 340/213.2 |
| 3,530,464 | 9/1970 | Young | 340/332 X |
| 3,739,334 | 6/1973 | Hocking | 340/332 X |
| 4,011,541 | 3/1977 | Fabry et al. | 340/332 X |

*Primary Examiner*—David L. Trafton

[57] ABSTRACT

A call button replacement circuit includes a controllable solid state switch that has a control terminal and a two-terminal output circuit, a manually operated switch, an indicator device, and a capacitor. The solid state switch is connected in circuit between a high voltage terminal and a call-acknowledge terminal; the manually operated switch is connected between the high voltage terminal and the control terminal of the solid state switch so that momentary actuation of the manually operated switch places the solid state switch in conducting condition and applies a call signal to the call-acknowledge terminal; the capacitor is connected between the call-acknowledge terminal and the control terminal, and the indicator device is connected in circuit with the solid state switch so that it is energized and produces a light output when the solid state switch is in conducting condition.

5 Claims, 5 Drawing Figures

ELEVATOR CALL CIRCUIT

This invention relates to elevator systems and more particularly to elevator call systems.

A commercially used elevator call device is a gas filled tube with an exposed surface that is activated by touch to call an elevator car. The touch tube is connected in circuit with a voltage applied across it but is normally non-conductive and acts essentially as an open circuit. Touching of the exposed surface causes the tube to break down and become conducting. In conducting condition the tube has an almost constant voltage drop and provides a car call signal. When the car stops at the requested floor, the voltage across the tube is reduced to a value less than that of the tube drop and the tube is turned off (becomes non-conducting) and remains non-conductive until retriggered.

These touch tube call devices are quite sensitive and frequently are inadvertently triggered, producing erroneous elevator calls. Under certain atmospheric conditions, for example conditions of high humidity, a touch tube may break down spontaneously causing the controlled car to stop at the floor specified by the tube. Also, if a tube cannot be turned off, the control circuitry may prevent the car from leaving the floor.

In accordance with the invention there is provided a call button replacement circuit for use in an elevator control system of the type that employs call buttons of the touch tube type and include a high voltage supply line, a common line, a call-acknowledge line, and a bias voltage supply line. The replacement circuit includes a controllable solid state switch that has a control terminal and a two-terminal output circuit, a manually operated switch, an indicator device, and a capacitor. The solid state switch is connected in circuit between the high voltage terminal and the call-acknowledge terminal; the manually operated switch is connected between the high voltage terminal and the control terminal of the solid state switch so that momentary actuation of the manually operated switch places the solid state switch in conducting condition and applies a call signal to the call-acknowledge terminal; the capacitor is connected between the call-acknowledge terminal and the control terminal, and the indicator device is connected in circuit with the solid state switch so that it is energized and produces a light output when the solid state switch is in conducting condition. In particular embodiments, a temperature sensitive disconnect is in circuit between the high voltage terminal and the solid state switch, and is arranged to disable the call circuit in a high temperature environment (e.g. 20° F. above the worst case ambient temperature), as may occur in case of fire. The replacement circuit may be used in either single riser or plural riser types of call circuits.

A touch tube call circuit (of the car type or the hall type, for example) may be disconnected from the circuitry at the immediate location (in the hall or car) and the replacement circuit wired directly in place in substitution for that circuit. No additional wires between the machine room (typically at the top of the elevator shaft) and the individual call circuits need be provided (although it may be desirable in particular instances to provide a modified voltage on at the high voltage terminal--and this may involve running an additional line where not all of the touch tube devices are to be replaced.) The replacement circuit is simple, inexpensive and reliable in operation.

Other objects, features and advantages will be seen as the following description of particular embodiments progresses, in conjunction with the drawings, in which.

DESCRIPTION OF PARTICULAR EMBODIMENTS

Figure 1:
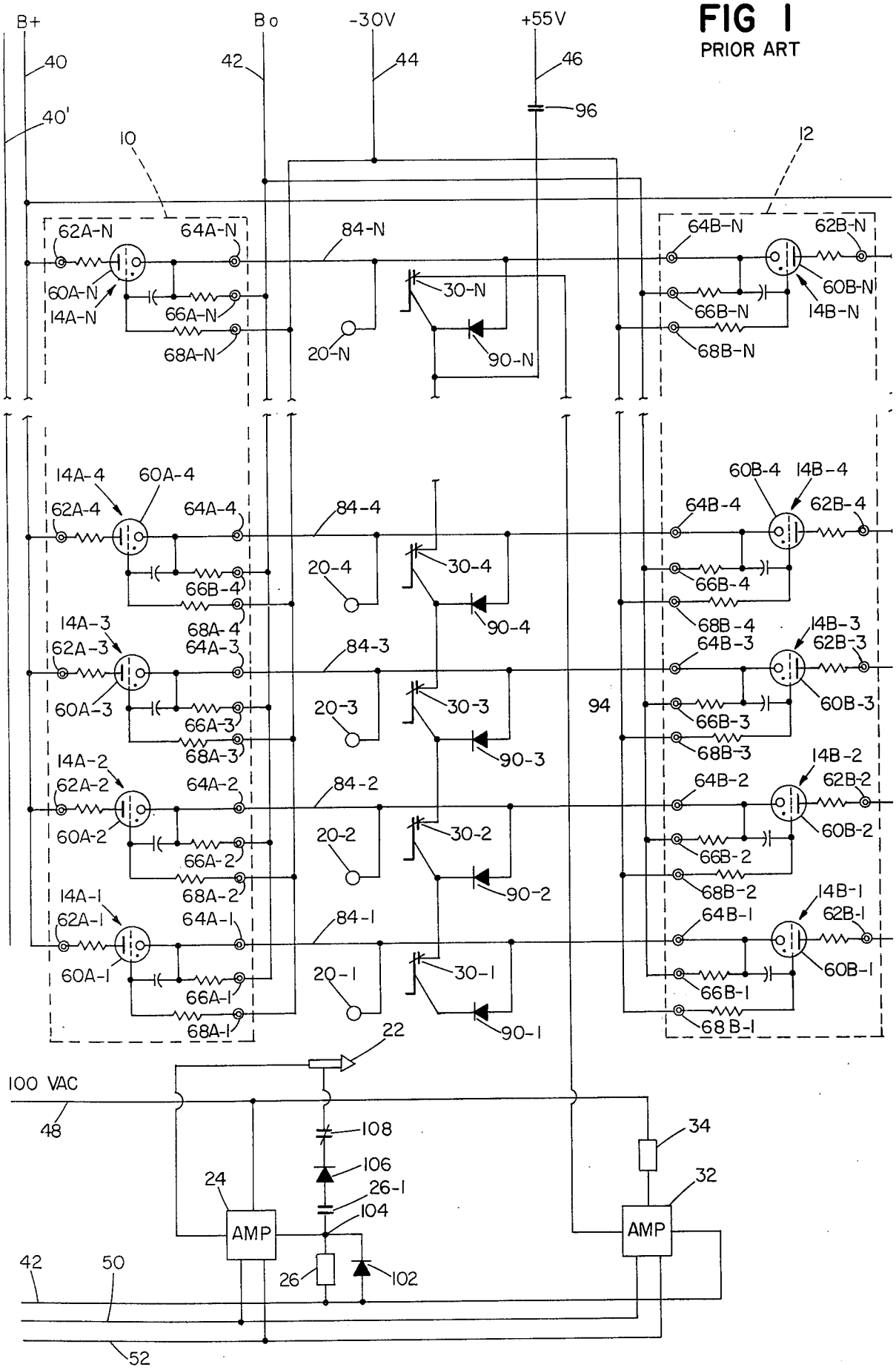
FIG 1 PRIOR ART
FIG. 1 is a schematic diagram of a car call device (two call devices per floor) of an elevator control system that employs a touch tube type call device.

Shown in FIG. 1 are two banks 10, 12 of call circuits 14 of the touch tube type in an elevator cab. Portions of the elevator control system associated with these two banks of call circuits are also shown in FIG. 1. Elevator control systems of this general type are well known in the art and only those portions of the elevator control system believed necessary for an understanding of the invention are shown in FIG. 1. It will be understood that such control system includes other call circuits such as hall buttons to which the control system responds and the replacement circuits of the invention are also applicable to such call devices. The two sets 10, 12 of call car circuits 14 are in the cab of an elevator which is raised and lowered by means of a hoisting motor which drives a hoisting sheave over which pass hoisting cables for the cab and for a counterweight. The control system includes a selector mechanism located in the machine room that has a series of fixed contacts 20, one per floor, and a movable wiper 22 that is driven from contact to contact 20 as in synchronism with the movement of the elevator car. Thus wiper 22 of the selector mechanism is in engagement with a contact 20 corresponding to the floor at which the elevator cab is located. An activated call circuit 14 applies a signal to the corresponding contact 20 of the selector mechanism, and when wiper 22 engages that energized contact, that signal is applied by wiper 22 to a car stop amplifier 24 to energize a car stop relay 26. When the car has stopped, an acknowledge signal is fed back through wiper 22 and the contact 20 engaged by that wiper as an acknowledge signal to reset at the activated call circuit. Also connected to the selector mechanism contacts 20 are a series of floor switches 30 connected in series circuit to a control amplifier 32 which controls an UP request relay 34. Relay 34 when energized, provides a signal commanding the hoisting motor to drive the car up. Similar DOWN controls (not shown) may also be provided.

As shown in FIG. 1, a number of supply lines are connected to the two banks of call circuits 14 (and to all other call circuits of the elevator system), including a B+ line 40 which typically has a DC voltage of about 135 volts, a $B_O$ or common line 42, a bias voltage line 44 (typical voltage on that line being −30 volts), and a supplemental signal line 46 (typically supplied with a +55 volt signal). Amplifiers 24 and 32 are supplied with a 100 volt AC signal over line 48, a cathode supply voltage on line 50, and a bias voltage on line 52. The amplifiers are also connected to the $B_O$ (common) line 42.

Each call circuit 14 includes a touch tube 60 and is connected to B+ line 40 at high voltage terminal 62, to its floor contact 20 at call-knowledge terminal 64, to the common line 42 at common terminal 66 and to the bias line 44 at bias terminal 68. Two call circuits 14A, 14B correspond to each floor. Thus the two call circuits for the third floor are identified as 14A-3 and 14B-3.

Figure 2:
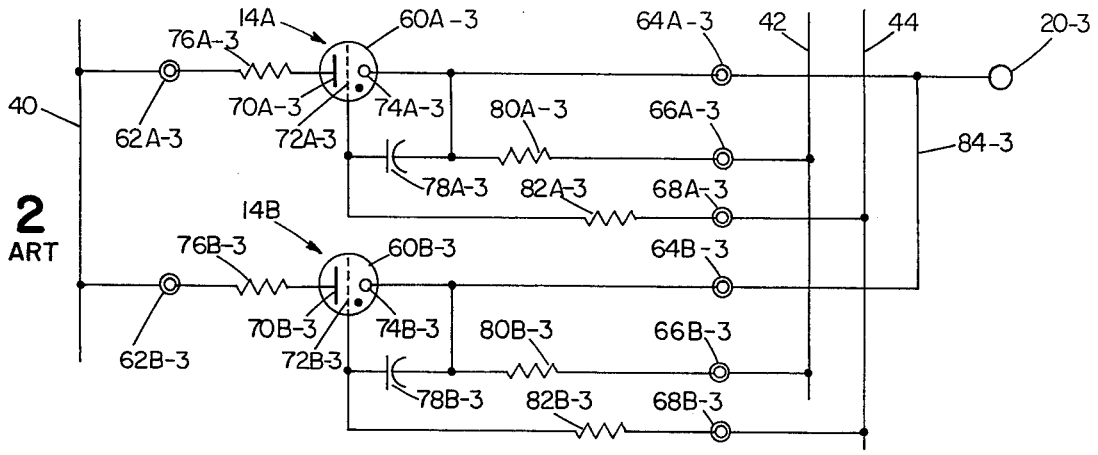
FIG 2 PRIOR ART
FIG. 2 is a schematic diagram of two of the car call circuits shown in FIG. 1.

Additional details of the touch tube type call circuits at floor 3 are shown in FIG. 2. Each touch tube 60 is a gas filled tube that has an anode 70, a grid 72 and a cathode 74. Each anode 70 is connected through resistor 76 to high voltage terminal 62, cathode 74 is connected to call-acknowledge terminal 64; and grid 72 is connected through capacitor 78 and resistor 80 to common terminal 66. In addition, the grid 72 is connected through resistor 82 to bias terminal 68.

When either tube 60 is touched, the tube will "break down" and conduct current. The voltage at call-acknowledge terminal and at selector mechanism contact 20 rises to about +55 volts, and provides a signal that a car call has been made. That voltage transition is also applied to the call-acknowledge terminal of the other touch tube circuit in the car via wire 84 connected between terminals 64A-3 and 64B-3 and is coupled by capacitor 78 to trigger the other touch tube 60. Thus both tubes corresponding to floor 3 in the call device banks 10, 12 are triggered into breakdown condition, and both produce a glow indicating the floor request.

With reference again to FIG. 1, a 55-volt signal at selector contact 20-3 is coupled by diode 90 through mechanical switch 30-3. Switches 30 are connected in series and each switch is open when the car is above the floor to which it corresponds. Thus, a car call for a higher floor is applied through the series of normally closed switches 30 to line 94 and input of amplifier 32 to energize the UP request relay 34. That relay when energized indicates the existence of a call at a higher floor and causes the hoisting motor to raise the elevator car until all UP calls have been satisfied. A simulated call may be applied to line 94 through the top switch contact 30-N and contacts 96 from the supply 46 so that the system will cause the car to service the top floor in each UP cycle. Opening of contacts 96 will remove this simulated call signal so that the elevator system responds only to floor calls and is not necessarily driven into the top floor in each cycle.

Thus, each car call is signalled in the machine room by the presence of the +55-volt signal on a selector contact 20. When the selector mechanism moves wiper 22 into engagement with such an energized contact 20, the 55-volt signal is transmitted over line 100 to amplifier 24 which energizes relay 26. Rectifier 102 causes the voltage at junction 104 to be a half wave rectified 100-volt AC signal. Energization of relay 26 closes contacts 26-1 and the AC signal is applied throuh diode 106 to RUN contacts 108. When the car stops, contacts 108 close and a pulsating (half wave rectified) 100-volt AC signal is applied through wiper 22 and its engaged contact 20 to the cathodes 74 of the two touch tubes at that floor. This applied voltage raises the potential of the cathodes 74 sufficient to cause conduction of the tubes 60 to cease, removing the +55-volt potential from that contact 20 and thus de-energizing amplifier 24 and relay 26. When relay 26 is deenergized, the control circuitry permits re-energization of the hoisting motor to move the car upward in response to the energized relay 34.

In summary, triggering of a touch tube into conduction fires all the corresponding touch tubes of that floor level and applies a +55-volt call potential to the corresponding selector contact 20. When selector wiper 22 engages such energized contact, the call signal is applied through amplifier 24 to energize stop relay 26. Contacts 108 close when the car stops and a pulsating 100-volt signal is fed back through wiper 22 and the contact 20 has an acknowledge signal to cause all the touch tubes in the circuit to cease conduction. The replacement circuit must be compatible with and respond to the system electrical signals in the same manner as does the touch tube circuits.

Figure 3:
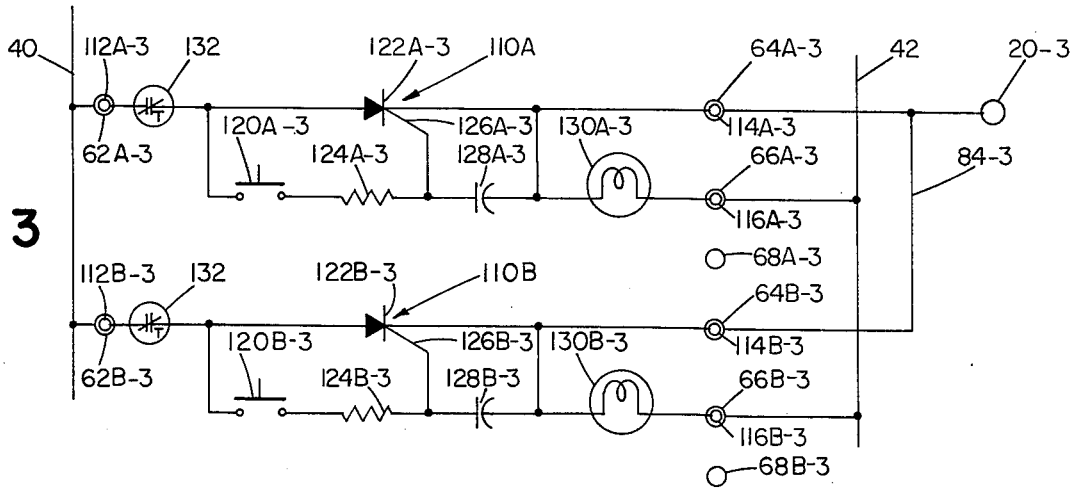
FIG. 3 is a schematic diagram of two circuits in accordance with the invention as replacement for the touch tube circuits shown in FIG. 2.

Two replacement circuits 110 for the two touch tube circuits 14 of FIG. 2 are shown in FIG. 3. It will be seen that each replacement circuit 110 is a three-terminal circuit having a high voltage terminal 112 for connection to high voltage terminal 62, a second terminal 114 for connection to call-acknowledge terminal 64, and a third terminal 116 for connection to common terminal 66. The replacement circuit does not use the bias voltage provided at terminal 68 for the touch tube circuits. Each replacement circuit 110 includes a manually operated, normally open switch 120 and a solid state switch in the form of SCR 122. The anode of SCR 122 is connected to the high voltage terminal 112 and its cathode is connected to the call-acknowledge terminal 114. Manual switch 120 provides a connection between high voltage terminal 112 through resistor 124 to the gate electrode 126 of SCR 122. Capacitor 128 is connected between the gate electrode 126 and call-acknowledge terminal 114. An indicator lamp 130 is connected between the cathode of SCR 122 and common terminal 116 and a normally closed, snap acting terminal switch 132 is connected between the anode of SCR 122 and high voltage terminal 112. Depending on the elevator installation, it may be desirable to change the voltage on supply bus 40, or if only certain touch tube circuits 14 are to be replaced (for example those in particularly troublesome environments such as the lobbies of hotels), to provide a separate regulated voltage source bus 40' (FIG. 1) for those replaced circuits only. A voltage dropping resistor may be utilized to provide the appropriate voltage at contact 20. Other voltage dropping devices such as Zener diodes could alternatively be utilized, as will be apparent.

In operation, when a normally open switch 120 is depressed, a circuit is completed through resistor 124 raising the voltage on gate electrode 126 and turning on the SCR 122. The SCR 122 in conducting condition raises the voltage at selector mechanism contact 20 to the call voltage level. That voltage transition is also fed back through line 84 and coupled through the capacitor 128 of the other call circuits connected to that contact 20 to trigger their SCRs 122 into conduction. Each SCR 120 in conduction energizes its associated indicator lamp 130 (located behind the button of switch 110). Thus momentary closure on one switch 120 energizes all the indicator lamps 130 at that floor level providing visual indication of the floor request. The call voltage is also applied to the selector contact 20 in the machine room. When the selector wiper 22 engages that energized contact, the call signal is applied via wiper 22 to amplifier 24 and energizes the car stop relay 26, closing contacts 26-1. When the car does stop, the RUN contacts 108 close and the pulsating AC signal from relay 26 is fed back through wiper 22 and applied to the cathodes of the SCRs 122 at that floor. This pulsating is sufficient to reverse bias each SCR and all conducting SCRs are turned off, extinguishing the indicator lamps 130 and acknowledging that the elevator car has stopped at the requested floor. Turn off of the SCRs 122 removes the call voltage from contact 20 and thus amplifier 24 de-energizes relay 26, allowing the hoisting motor to be re-energized. Should a fire break out at a particular floor level, the switch 132 will open and disable the call circuit. The fire fighter service may be arranged to bypass the switch 132 to provide override control.

Figure 4:
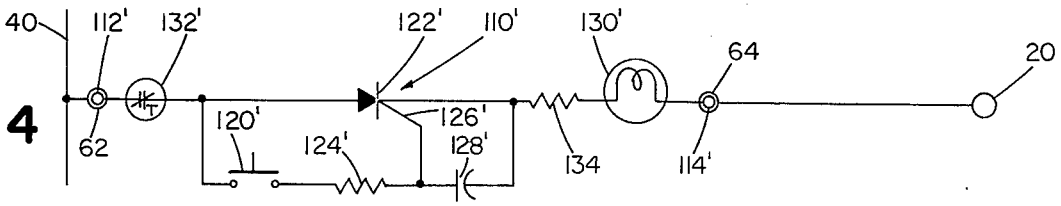
FIG. 4 is a schematic diagram of a further replacement circuit embodiment in accordance with the invention.

The replacement circuit shown in FIG. 4 is suitable for a single riser installation (a single rather than plural call devices at a particular floor level). That replacement circuit is a two-terminal circuit having a high voltage terminal 112' for connection to terminal 62 and a call-acknowledge terminal 114' for connection to terminal 64. Manually operated normally open switch 120' has an indicator lamp 130' behind its button. Lamp 130' is connected in series between the cathode of SCR 122' and terminal 114'; switch 120' is connected between the high voltage terminal 112' and the gate 126' of SCR 122' through a current limiting resistor 124'. A noise immunity capacitor 128' is connected between the gate and cathode of the solid state switch 122'. As in plural riser circuits, a voltage control device such as a resistor 134 or a Zener diode may also be connected in circuit between the cathode of SCR 122' and all-acknowledge terminal 114' to provide an appropriate call voltage level at contact 20.

Figure 5:
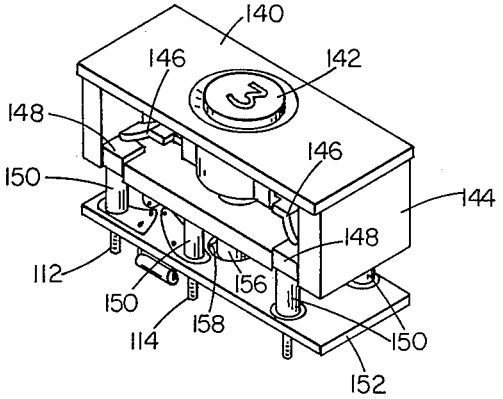
FIG. 5 is a perspective view of a replacement call circuit unit in accordance with the invention.

Shown in FIG. 5 is a replacement call unit that includes a mounting plate 140 in the center of which is located push button 142 of the manually operated switch 120. Secured to the mounting plate 140 is switch body 144 which carries movable wiping contacts 146 and fixed contacts 148. Secured to switch body 144 by standoffs 150 is a printed circuit board 152 that carries components of the call circuit. Call circuit terminals 112, 114, 116 extend downwardly away from the circuit board 152. Lamp 130 is mounted in a removable housing 156 that extends downwardly through hole 158 in circuit board 152.

Thus the invention provides a simple and inexpensive replacement circuit that is compatible with the existing touch tube type control circuits and avoids the sensitivity and other problems which frequently befall touch tube type controls. The circuit may be used as a direct replacement for a touch tube unit in elevator call button applications, and may be installed directly without additional wiring or controller changes. No floor relays or magnets are required. It is easily adaptable to a wide range of voltage environments so that it may interface with existing solid state or conventional controllers and provides "cross-fire" capability for multiple call button applications without additional wiring. The circuit is completely insensitive to light, does not require an electrical shield for stability, and is less sensitive to moisture than the touch tube circuits, eliminating problems created by high humidity or cleaning agents.

While particular embodiments of the invention have been shown and described, other embodiments will be apparent to those skilled in the art and therefore it is not intended that the invention be limited to the disclosed embodiments and departures may be made therefrom within the spirit and scope of the invention.

What is claimed is:

1. A call button replacement circuit for use in an elevator control system designed to employ call devices of the touch tube type, comprising a high voltage supply terminal, a call-acknowledge terminal, a controllable solid state switch having a control electrode and a controlled circuit connected in series between said high voltage terminal and said call-acknowledge terminal, a temperature sensitive disconnect connected in circuit between said high voltage supply terminal and said solid state switch for disabling said call button circuit in the presence of temperature substantially above ambient, a manually operable switch connected in circuit between said high voltage terminal and said control electrode for triggering said solid state switch into conduction, a capacitor connected between said call-acknowledge terminal and said control electrode, and an indicator device connected in circuit with said solid state switch for energization when said solid state switch is triggered into conduction, said circuit being arranged so that said solid state switch remains in conduction after triggering until released by an acknowledge signal applied to said call-acknowledge terminal.

2. The circuit as claimed in claim 1 wherein said solid state switch is a controlled rectifier.

3. The circuit as claimed in claim 1 wherein said manually operated switch has normally open contacts.

4. The circuit as claimed in claim 1 and further including a common terminal, said indicator device being connected in circuit between said solid state switch and said common terminal.

5. The circuit as claimed in claim 4 wherein said solid state switch is a controlled rectifier, said manually operated switch has an actuator button and normally open contacts, and said indicator device is an indicator lamp mounted behind said actuator button.

* * * * *